US005134866A

United States Patent [19]

Enderlin

[11] Patent Number: 5,134,866

[45] Date of Patent: Aug. 4, 1992

[54] APPARATUS FOR THE THERMAL TREATMENT OF TEXTILE FIBERS

[75] Inventor: Robert Enderlin, Morschwiller-le-Bas, France

[73] Assignee: Passap Knitting Machines, Inc., Salt Lake City, Utah

[21] Appl. No.: 620,864

[22] Filed: Dec. 4, 1990

[51] Int. Cl.[5] ..... D06B 5/06

[52] U.S. Cl. ..... 68/5 D

[58] Field of Search ..... 68/5 D, 5 E; 28/281; 34/155

[56] References Cited

U.S. PATENT DOCUMENTS 3,585,696 6/1971 Aronoff ..... 68/5 D X
4,674,197 6/1987 Fleissner ..... 34/155 X

FOREIGN PATENT DOCUMENTS 695582 8/1953 United Kingdom ..... 68/5 D
8806653 9/1988 World Int. Prop. O. ..... 28/281

*Primary Examiner*—Philip R. Coe

*Attorney, Agent, or Firm*—Sandler, Greenblum & Bernstein

[57] ABSTRACT

A heat treatment chamber for textile threads continuously treats the textile threads utilizing forced circulation units of a treatment fluid. The circulation units are these units being crossed consecutively by a conveyor belt that carries a lap of threads. Each circulation unit is provided with a blower and a closed circuit or an open circuit for the treatment fluid (air or steam). A heat exchanger is positioned near the conveyor belt, in such a way that the fluid crosses it and takes the desired temperature immediately before crossing the lap of threads. The heat exchanger can be formed of longitudinal tubes criss-crossed by heating or cooling fluid. Such a chamber is usable either to preheat the threads, to maintain them heated, or to cool them. The forced circulation units can ensure a gradual variation in the temperature of the threads in the same treatment chamber, or can enable a homogeneity to be obtained in a particular portion of the tunnel, by virtue of the communication between at least two forced circulation units that function in open circuit with the surrounding zone.

16 Claims, 4 Drawing Sheets

APPARATUS FOR THE THERMAL TREATMENT OF TEXTILE FIBERS

BACKGROUND OF THE INVENTION

1. Field of the Invention

The present invention concerns an apparatus having a heat treatment chamber for textile threads that are continuously deposited and transported on a continuous perforated conveyor belt which is continuously driven through the chamber. The apparatus has a tubular enclosure that demarcates the treatment chamber. The apparatus is equipped with an entrance and an exit for the conveyor belt and the threads. At least one forced circulation unit provided within the treatment chamber. Furthermore, the apparatus is provided with a casing which is crossed by the conveyor belt, the casing defining a fluid treatment circuit, with treatment fluid being comprised of air and/or of steam. The circuit has at least one blower to force the treatment fluid to vertically through the conveyor belt and the threads.

2. Discussion of Background and Relevant Information

The International Patent Application published under the number W088/06653 shows, especially in FIGS. 4 and 5, such a heat treatment chamber having three forced circulation units, each of them having a casing forming a closed circuit treatment fluid. In this circuit, a blower positioned above the conveyor belt sucks in a fluid, that is comprised of hot air or a mixture of air and steam, and the blower then recycles the fluid towards the base of the casing, via a lateral conduit in (which the fluid temperature may be adjusted to a predetermined value) by injection of steam or cold air. One of the functions of these units is to create treatment conditions that vary gradually along the trajectory of the belt, according to the threads carried by the unit. Another function may consist of maintaining predetermined conditions at each point of the trajectory in case of a non-desired stop of the belt. However, in practice, the means that are provided for adjusting the temperature do not easily enable obtaining the exact temperatures and conditions that are substantially different from the forced circulation unit positioned in the same treatment chamber.

SUMMARY OF THE INVENTION

Accordingly, the present invention aims to improve upon the art that has been mentioned above, in such a way so as to ensure an individual adjustment of the heat treatment in the different zones of the treatment chamber. A secondary aim consists of creating a type of fluid circuit that would be applicable either for heating or for cooling the threads.

In general, the present invention concerns a heat treatment chamber of a type that has been specified above. More specifically, he invention is directed to a heat exchange means that is associated with each forced circulation unit which includes at least one heat exchanger which extends parallel along the conveyor belt within the casing of the forced circulation unit, upstream of the conveyor belt and the threads with respect to the direction of the flow of the treatment fluid in such a way that the said treatment fluid circuit crosses the said heat exchanger immediately before crossing the conveyor belt. Thus, the treatment fluid may be heated or cooled, according to the necessities of the place or the moment, immediately before coming into contact with the threads transported by the conveyor belt. Moreover, as the temperature of the treatment fluid is adjusted by contact with the heat exchanger, the composition of the fluid is not altered. This is especially advantageous when the treatment fluid circuit is an open one, i.e., when the fluid can move from inside one of the units to the space surrounding this unit in the treatment chamber.

The heat exchanger can be positioned below the conveyor belt, and may be crossed vertically upwardly by the treatment fluid. In another embodiment of the invention, the said exchanger may be positioned above the threads deposited on the conveyor belt and may be crossed vertically downwardly.

In a preferred embodiment of the invention, each of the heat exchangers includes a plurality of tubes that together form a circuit for a heating fluid or a cooling fluid, which fluid is delivered by a source positioned on the outside of the treatment chamber. The circuit includes a pair of entry and exit conduits that cross the tubular enclosure. Preferably, the tubes of each heat exchanger are positioned parallel to one another in a longitudinal direction with respect to the conveyor belt. The heat exchanger can include an entry collector and an exit collector at one end, that are respectively connected to the entry and exit conduits. At its other end, the heat exchanger may have an intermediate collector, and the tubes may include a first set of tubes that are connected between the entry collector and the intermediate collector, and are parallel to one another, and as well as a second set of tubes that are parallel to one another and are connected between the intermediate collector and the exit collector.

A first flow divider grid may be positioned on one surface of the heat exchanger on the side that is opposite to the conveyor belt, this grid being attached on its periphery to the casing in such a way so as to be crossed by the treatment fluid entering the heat exchanger. Preferably, the first grid is provided with perforations that are uniformly distributed on the entire surface in order to enable a fluid flow to pass through this grid in a uniform way throughout the entirety of the grid. A second flux divider grid is positioned between the heat exchanger and the conveyor belt, this grid being joined at its periphery to the casing in such a way so as to be crossed by the treatment fluid exiting the heat exchanger. Preferably, this second grid is provided with perforations that are uniformly distributed on the entire surface, in order to enable the flow of fluid to traverse this grid in a uniform way throughout the entirety of the grid.

In another preferred embodiment of the invention, the blower is positioned in a portion that projects towards the top of the casing, and the treatment fluid circuit comprises of a pair of descending channels positioned symmetrically on both sides of the casing, these channels ending in a dividing chamber that extends under the first divider grid, along a length that is substantially equal to the length of the heat exchanger.

In at least one forced circulation unit, the casing may be provided with openings that are equipped with removable caps, the said openings of which enable enabling the treatment fluid circuit to be opened by communication with a surrounding zone in the treatment chamber. In a special embodiment, the respective treatment fluid circuits of at least two forced circulation units are open circuits, and communicate between themselves in the surrounding zone in order to homogenize the treatment fluid within this zone.

In order to ensure a gradual variation of the treatment, for example, a variation in temperature, the treatment chamber preferably comprises a plurality of the said forced circulation units that are placed one behind the other, along the conveyor belt, and that are each provided with separate supply means for their respective heat exchangers.

BRIEF DESCRIPTION OF THE DRAWINGS

A preferred embodiment of the invention, is described below as an example, with reference to the annexed drawings. In the drawings:

FIG. 5 illustrates the functioning of the forced circulation unit in an open circuit.

DESCRIPTION OF THE PREFERRED EMBODIMENTS

Figure 1:
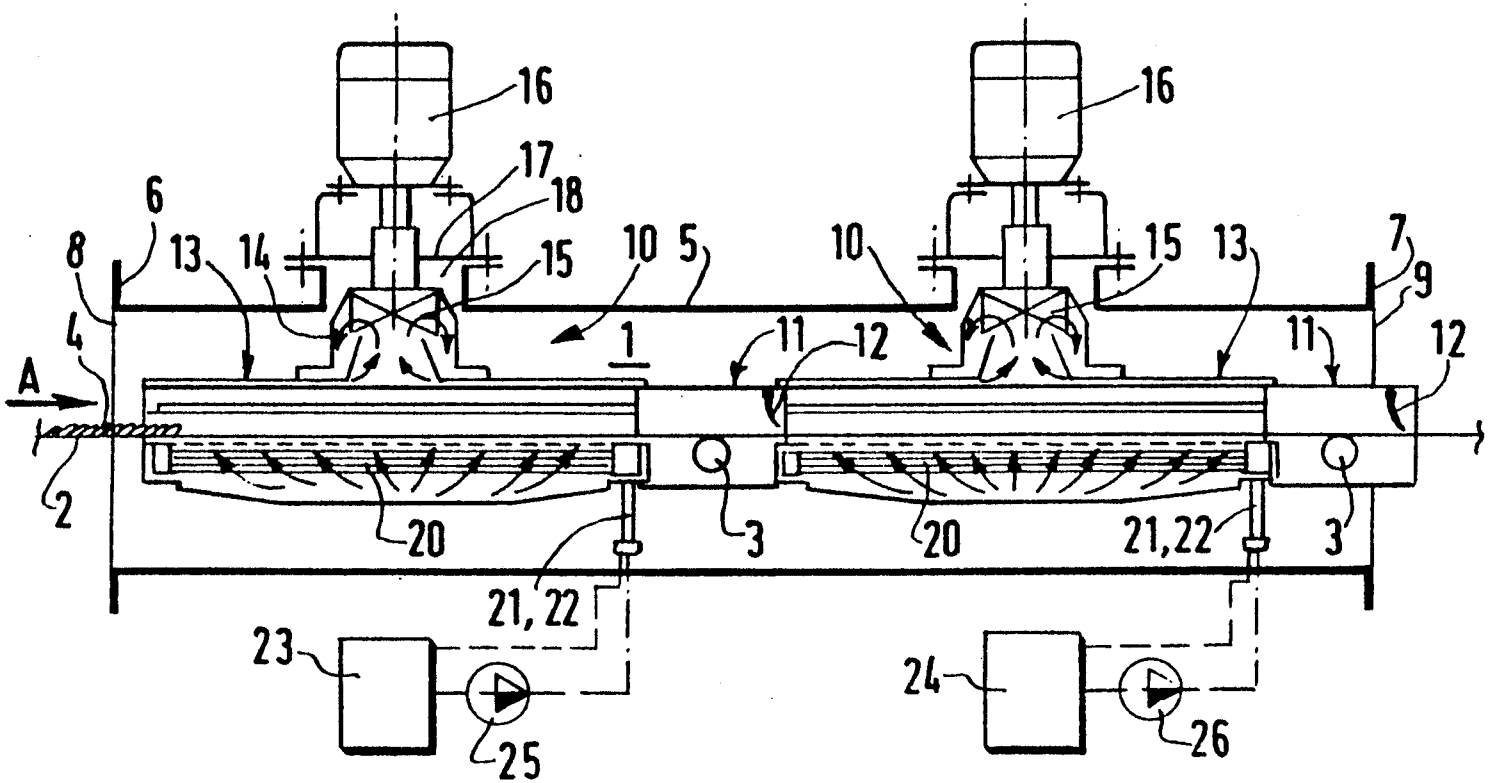
FIG. 1 is a schematic view of a longitudinal section of a heat treatment chamber for textile threads, wherein the heat treatment chamber comprises two forced circulation units.

FIG. 1 which is shows a heat treatment chamber 1, longitudinally traversed by a continuous conveyor belt 2 that is continuously driven along the direction of arrow A. The belt 2 rests on rotating rollers 3 within the chamber 1. The belt 2 is a perforated metallic belt, on which a lap of textile threads 4 is continuously deposited in order to be treated in chamber 1. These threads are only partially represented in order to simplify the drawings. The chamber 1 is demarcated by a tubular envelope 5 having a circular or other transverse section. We have only represented a single modular element of envelope 5 here, having end flanges 6 and 7 in order to be coupled with other elements, respectively at its entry 8 and its exit 9. The said elements may be, for example, sealed heads that shut the chamber, and that enable belt 2 (as well as threads 4) to move, and which further enable a steam pressure to be maintained in the interior of chamber 1. However, the tubular envelope element 5 may also be affixed to another similar element in order to form a longer treatment chamber.

In the example represented in FIG. 1, the treatment chamber 1 is equipped with two consecutive forced circulation units 10, that are autonomous from each other, and that are positioned one downstream the other relative to the path of travel of the conveyor belt 2. Each unit 10 is followed by a connecting element 11 that may contain a valve device 12 that separates the respective interior atmospheres of the two units 10. Each forced circulation unit has an elongated casing 13 made of sheet metal, that surrounds the conveyor belt 2 along the entire length of the unit. At mid-length, the casing 13 has a projecting upper portion 14 within which a blower 15 is positioned, with the blower being driven by an electric motor 16. This motor 16 is mounted on a cap 17 that seals a corresponding upper opening 18 of enclosure 5. In each unit 10, the blower 15 has the function of making the treatment fluid circulate, either in closed or open circuit, with respect to the interior of chamber 1, this treatment fluid, for example, being of cold or hot air, a mixture of hot air and of steam, of overheated steam under pressure, etc., depending upon the type of treatment, and the stage of treatment to be implemented. Immediately before coming into contact with threads 4, the treatment fluid is reheated and recooled by a heat exchanger 20 positioned below the conveyor belt 2 and provided with an entry conduit 21 and an exit conduit 22 that are connected outside enclosure 5 at one or several sources 23, 24 of heating or cooling fluid, as well as at pumps 25, 26, as has been represented schematically in FIG. 1. The output and the heating or cooling fluid temperature in exchanger 20 are adjustable by means not illustrated in the figures. The speed of blower 15 is also adjustable in order to modulate the treatment of the threads in each unit 10.

Figure 2:
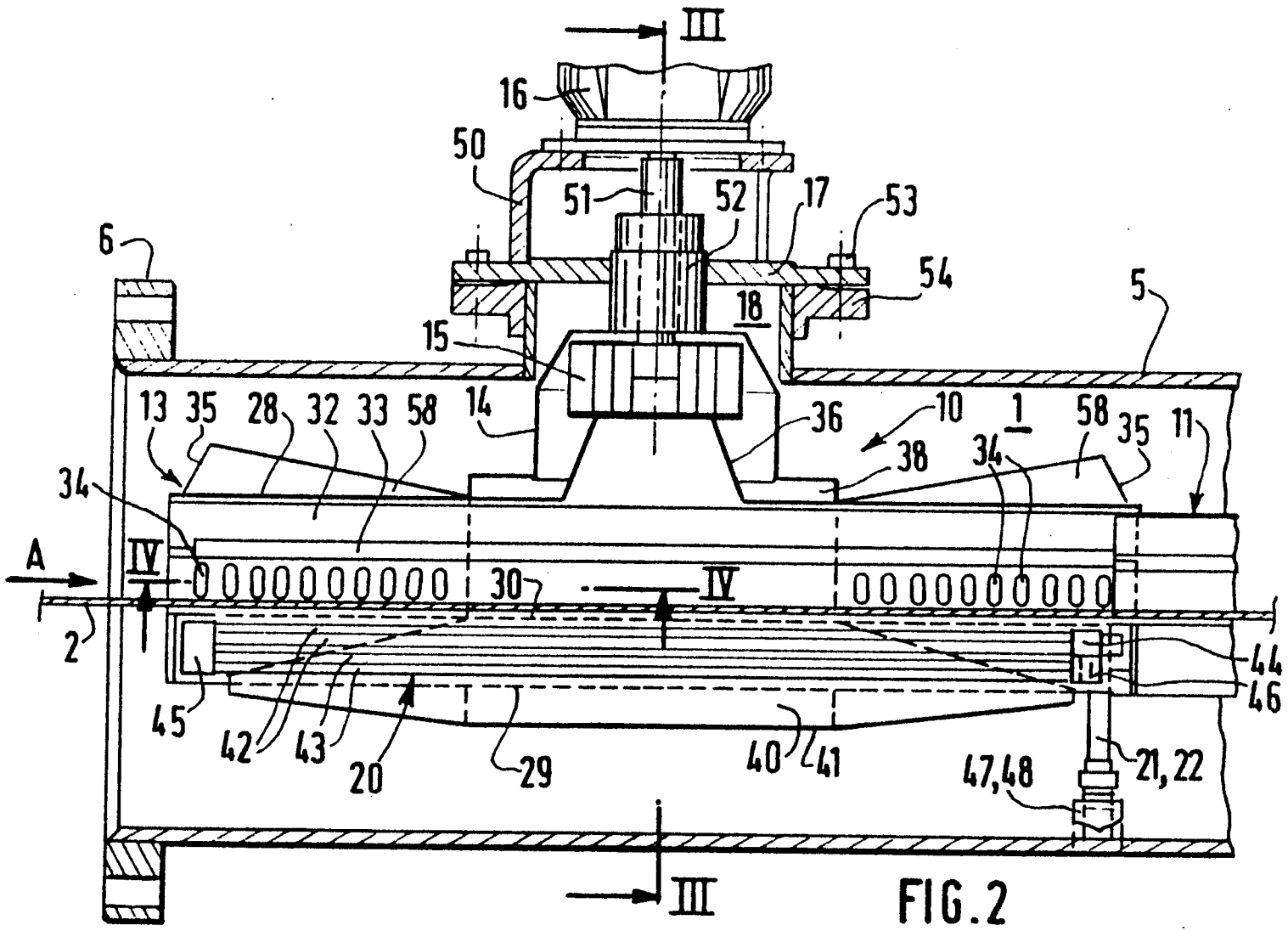
FIG. 2 represents, on an enlarged scale, a portion of FIG. 1, and shows the construction of the forced circulation unit in more detail.
Figure 3:
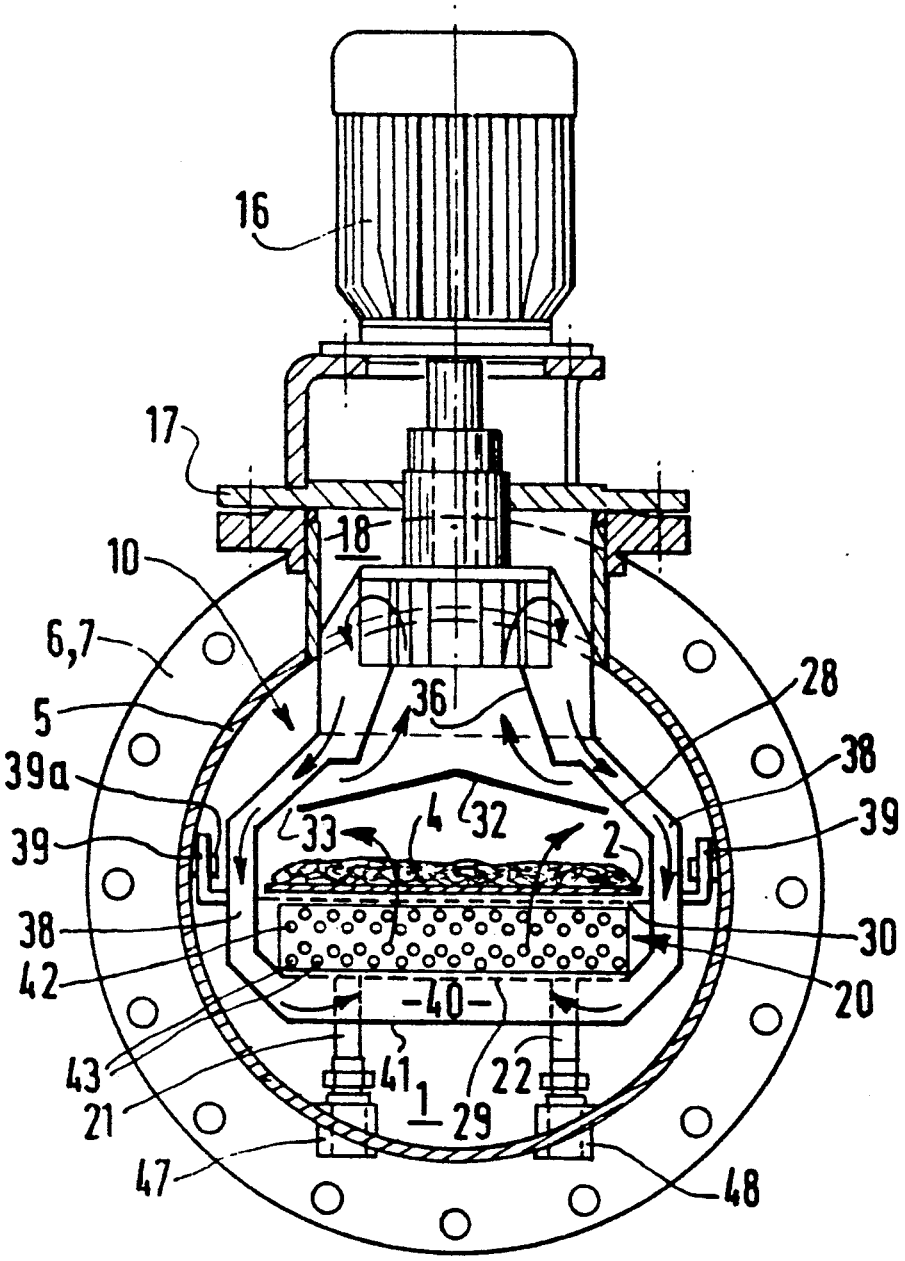
FIG. 3 is a transverse section following line III—III of FIG. 2.
Figure 4:
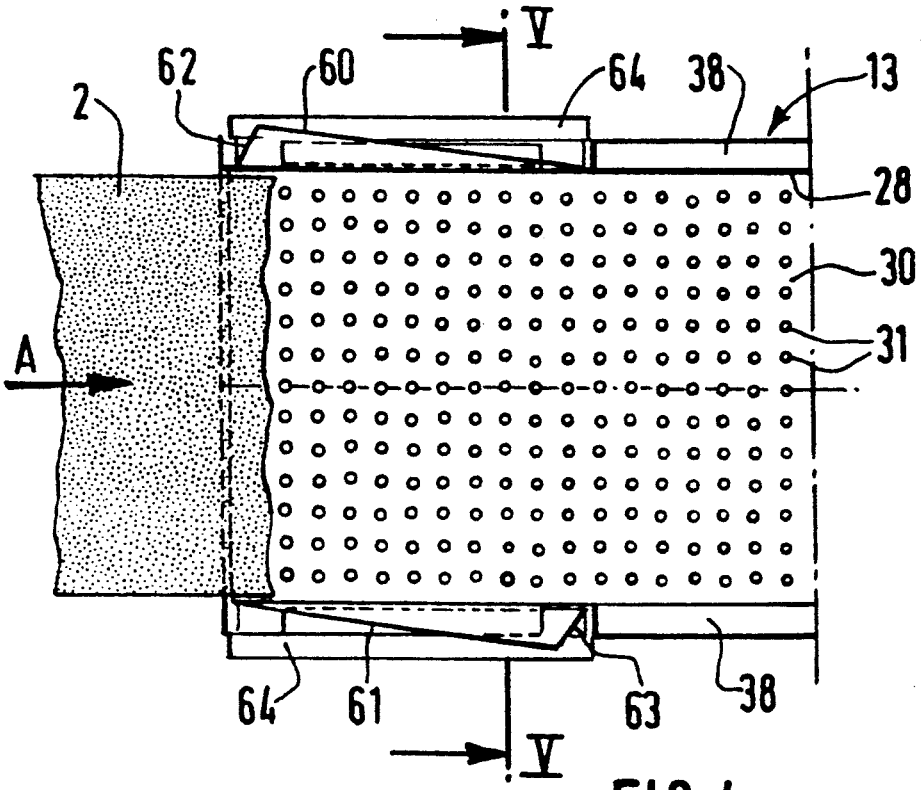
FIG. 4 is a partial view of a horizontal section that follows line IV—IV of FIG. 2.
Figure 5:
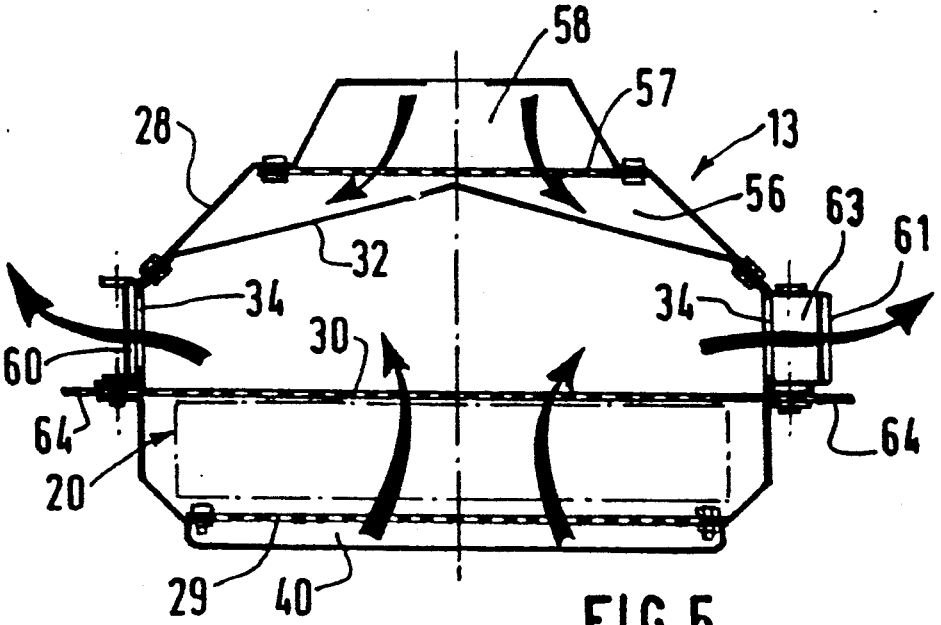
FIG. 5 is a schematic view of a transverse section that follows line V—V of FIG. 4.

FIGS. 2–5 show the construction of one of the forced circulation units 10 in more detail, and in particular, the shape of its sheet metal casing 13. The said casing includes a tubular portion 28 having a transverse section that may have an approximately rectangular shape, or other shape. The tubular portion 28 surrounds conveyor belt 2 and heat exchanger 20, and has therein a bored plate 29 which forms (below the heat exchanger 20), a first divider grid for the treatment fluid. A second divider grid 30 is positioned within casing 13, above exchanger 20 and immediately below conveyor belt 2. Like the first grid 29, it is made of sheet metal perforated with holes 31, as shown in FIG. 4. The tubular portion 28 also contains a ceiling 32, that extends above threads 4 and that enables the treatment fluid to pass only via two lateral slits 33 (see FIG. 3). The tubular portion 28 of the casing may further comprise lateral openings 34 as shown in FIG. 5 and upper openings 35, (as shown in FIG. 2) provided with movable or removable caps, in such a way as to enable communication (or lack of communication), between the interior of casing 13 and the space surrounding chamber 1, in order that the treatment fluid circulates respectively in open circuit or closed circuit within unit 10. In the following descriptions, it is assumed that openings 34 and 35 are closed and that the fluid treatment circuit is closed.

The closed circuit of the treatment fluid has a suction cone 36 positioned within the projecting portion 14. Suction cone 35 drives the fluid to an axial entry of the centrifugal blower 15, after which the fluid again moves downwardly around the outside the cone 36, as indicated by the direction-of-flow arrows in FIG. 3. The flow of the fluid is then split into two streams as it flows into the lower portion of the casing and moves via two lateral channels 38 positioned symmetrically on either side of the tubular portion 28 of the casing. These channels 38 are flared towards the base in order to distribute the fluids all along the length of the divider chamber 14 that extends under grid 29, this chamber being demarcated by a lower wall 41 made of sheet metal. The casing 13 is equipped with supports 39 that are affixed to the tubular enclosure 5 by means of bolts 39a.

In a preferred embodiment represented here, the heat exchanger 20 is formed by two groups of longitudinal tubes 42 and 43 that respectively connect an entry collector 44 and an intermediate collector 45, and this collector 45 to an exit collector 46 (see FIG. 2). The collectors 44 and 46 are connected to conduits 21 and 22. These cross the tubular enclosure 5 by means of respective attachments 47 and 48. Thus, the collectors and the tubes of exchanger 20 form a circuit for a heating fluid such as water vapor, or for a cooling fluid such as cold water. Alternatively, exchanger 20 may include tubes that have electric resistors for the heating. This gaseous mixture acts as the treatment fluid for the threads, and is reheated or recooled at a desired temperature by contact with tubes 42, 43 immediately before crossing the conveyor belt 2 and the lap of threads 4 which resting on this belt. This special arrangement of the exchanger 20 especially enables working with temperatures in forced circulation units 10 that are substantially different from the treatment fluids contained in a same treatment chamber 1, despite the heat exchanges that are capable of being produced between these units. Moreover, this symmetrical arrangement and the flared shape of the lateral channel 38, as well as the presence of divider grids 29 and 30, enable the production of a regular and homogeneous flow of treatment fluid on the entire surface of the lap of threads 4 within each unit 10. Also, the position of exchanger 20 guarantees a very efficient check of the treatment fluid temperature, especially when it is cooled.

FIGS. 2 and 3 also show how motor 16 of blower 15 is mounted on a lid 17 by means of an appropriate support 50. The shaft 51 of the blower is supported by a bearing 52 mounted on the lid 17, the latter being affixed by bolts 53 to a plate 54 surrounding the opening 18. This arrangement enables the blower to be easily disassembled for maintenance purposes.

FIGS. 4 and 5 show a more detailed representation of means for enabling the circulation of the treatment fluid in open circuit in casing 13 of unit 10. This means draws the fluid into a zone that surrounds chamber 1 (i.e., outside casing 13), following which the fluid is rejected into another area of the zone. In this event, slits 33 (FIGS. 2 and 3) are sealed by appropriate caps, in such a way that ceiling 32 defines an upper conduit 56 in the upper portion of casing 13. The channel communicates with the outside of the casing by upper openings 57 and two suction conduits 58, each having an entry opening 35 (FIG. 2). The openings 57 are closed by caps when the unit works in a closed circuit arrangement.

Outside the casing, deflectors 60 and 61 are placed in front of the lateral openings 34. Each of deflectors 60 and 61 have an exit orifice (respectively 62 and 63), oriented differently in order to direct the treatment fluid in such a way so as to collect it in the treatment chamber in a zone that surrounds casing 13, before a part of this fluid is sucked in again by the same unit 10, or by a neighboring unit 10. Deflectors 60, 61 are formed by sheets that are mounted in an adjustable and removable manner on lateral stabilizers 64, of the tubular portion 28 of casing 13.

In an open circuit embodiment, the treatment fluid circulates as is indicated by the direction-of-flow arrows of FIG. 5. Blower 15 sucks fluid coming from outside casing 13 by openings 35 and passing through conduits 58, 56, and cone 36. The fluid ejected by the blower passes into the lateral channels 38, into chamber 40, and through exchanger 20, before crossing conveyor belt 2 and threads 4. The fluid then escapes, via openings 34, 62 and 63. When several forced circulation units 10 function in this way in the same treatment chamber 1, the treatment fluid may be homogenized in the zone of the chamber that surrounds these units, and at the same time, the treatment fluid can be regulated with great precision conditions in within each forced circulation unit.

The invention described above is applicable to different types of heat treatments of textile threads, especially for thermal fixation of a dyeing or for the crinkle (i.e., crimping) process of synthetic threads. The treatment chamber may be a preheating chamber, a hot chamber where the treatment itself is done, or, a cooling chamber after a heat treatment. One can therefore create different consecutive chambers in the same machine, by using modular units 5 and 10 in each of them, in a way that has been described above. The combination of several forced circulation units 10 enables the treatment temperature to be modulated as desired in the different zones of a chamber, and to impose different temperature curves along the trajectory of the threads, in accordance with the different qualities of threads to be treated.

I claim:

1. A yarn treatment chamber comprising:

a yarn conveyor belt;

a tubular enclosure having an inlet and an outlet for said yarn conveyor belt;

at least one forced circulation unit positioned inside the yarn treatment chamber, wherein the circulation unit is provided with a casing that is traversed in a direction of travel by said conveyor belt and wherein the casing defines a circuit for a yarn treatment fluid, wherein the yarn treatment fluid is at least one member selected from the group consisting of air and stream, and wherein the circuit has at least one blower to force the treatment fluid to pass substantially vertically through perforations in said conveyor belt as well as yarn being treated; and at least one heat exchange means associated only with a single forced circulation unit, wherein the heat exchange means comprise at least one heat exchanger in the form of tubes extending substantially parallel to the direction of displacement of said conveyor belt which is inside the casing of said at least one forced circulation unit, wherein with respect to the direction of yarn treatment fluid flow, the heat exchange means is positioned upstream of both the conveyor belt and the yarn being treated, so that the treatment fluid crosses the heat exchange means substantially immediately before passing through perforations in the conveyor belt.

2. The yarn treatment chamber as described in claim 1, further including at least one means for regulating the temperature of the yarn treatment fluid.

3. The yarn treatment chamber as described in claim 2, wherein said at least one means for regulating the temperature comprise means for heating the yarn treatment fluid.

4. The yarn treatment chamber as described in claim 2, wherein said at least one means for regulating the temperature comprise means for cooling the yarn treatment fluid.

5. The yarn treatment chamber as described in claim 2, wherein the heat exchange means is positioned substantially under said conveyor belt, and wherein the yarn treatment fluid crosses said heat exchange means in a substantially vertically upward direction.

6. The yarn treatment chamber as described in claim 2, wherein the tubes of each heat exchanger together form a circuit for a heating fluid or a cooling fluid delivered by a source that is outside the treatment chamber, and wherein the circuit has a pair of entry and exit conduits that pass through the tubular enclosure.

7. The yarn treatment chamber as described in claim 6, wherein the tubes of each heat exchanger are positioned in a longitudinal direction with respect to the conveyor belt, and are positioned substantially parallel to one another.

8. The yarn treatment chamber as described in claim 7, wherein the heat exchange means includes, at one end, an entry collector and an exit collector that are respectively attached to the entry and exit conduits, and at the other end, an intermediate collector, so that the tubes comprise:

a) first tubes that are substantially parallel and are connected between the entry collector and the intermediate collector, and b) second tubes that are substantially parallel and are connected between the intermediate collector and the exit collector.

9. The yarn treatment chamber as described in claim 2, wherein said at least one blower projects towards a top portion of the casing, and wherein the treatment fluid circuit includes a pair of channels that extend downward, and wherein the channels are positioned symmetrically on two sides of the casing, these channels ending in a divider chamber that extends under a first divider grid, along a length that is substantially equal to the length of the heat exchanger.

10. The yarn treatment chamber as described in claim 1, wherein a first flow divider grid is positioned on a surface of the heat exchanger located on a side of the heat exchanger that is opposite the conveyor belt, the grid being joined at its periphery to the casing so that the treatment fluid entering the heat exchanger crosses the grid.

11. The yarn treatment chamber as described in claim 10, wherein a first grid is provided with perforations that are spread substantially uniformly throughout the entire surface of the grid in order to enable the flow of fluid to pass through this grid in a substantially uniform manner throughout the entirety of the grid.

12. The yarn treatment chamber as described in claim 10, wherein a second flow divider grid is positioned between the heat exchanger and the conveyor belt, this grid being affixed at its periphery to the casing so that the treatment fluid exiting from the heat exchanger crosses the second grid.

13. The yarn treatment chamber as described in claim 12, wherein the second grid is provided with perforations that are distributed substantially uniformly throughout the entire surface thereof, in order to enable the flow of fluid to pass through this grid in a substantially uniform manner throughout the entirety of the grid.

14. The treatment chamber as described in claim 1, wherein, in at least one forced circulation unit, the casing is provided with openings equipped with removable caps, wherein the openings enable the treatment fluid circuit to communicate with a zone that surrounds the treatment chamber.

15. The yarn treatment chamber as described in claim 14, wherein respective treatment fluid circuits of at least two forced circulation units are open circuits, and wherein the circuits communicate between each other in the surrounding zone to homogenize the treatment fluid in this zone.

16. The yarn treatment chamber as described in claim 1, wherein a plurality of the forced circulation units are placed one behind the other along the conveyor belt, and wherein each of the circulation units are provided with separate fluid supply means for each heat exchanger.

* * * * *

UNITED STATES PATENT AND TRADEMARK OFFICE

CERTIFICATE OF CORRECTION

PATENT NO. : 5,134,866

DATED : August 4, 1992

INVENTOR(S) : Robert ENDERLIN

It is certified that error appears in the above-indentified patent and that said Letters Patent is hereby corrected as shown below:

Cover page, 57/Abstract (line 2), after "utilizing" insert ---several---.

Cover page, 57/Abstract (line 4), delete "these units being".

At column 1, line 15, after "unit" insert ---is---.

At column 1, line 21, after "cally" insert ---pass ---.

At column 1, line 30, after "fluid" delete ",".

At column 1, line 32, after "conduit" insert ---(---.

At column 1, line 33, before "which" delete "(".

At column 1, line 57, change "he" to ---the---.

At column 2, lines 63-64, after "enable" delete "enabling".

At column 3, line 6, delete "said".

At column 3, line 27, after "FIG. 4", change "," to ---.---.

At column 3, line 46, delete "said".

At column 4, line 22, delete "said".

At column 5, line 10, change "resting" to ---rest---.

At column 6, line 1, delete "conditions in".

Signed and Sealed this

Twenty-fifth Day of June, 1996

*Attest:*

Bruce Lehman

BRUCE LEHMAN

*Attesting Officer*

*Commissioner of Patents and Trademarks*